US008517439B2

(12) United States Patent
Haun et al.

(10) Patent No.: US 8,517,439 B2
(45) **Date of Patent: *Aug. 27, 2013**

(54) DETACHABLE EARS ROPE THIMBLE

(76) Inventors: Richard D. Haun, Richmond, TX (US); Richard E. Hall, Covington, LA (US); Peter L. Kazunas, Mandeville, LA (US)

( * ) Notice: Subject to any disclaimer, the term of this patent is extended or adjusted under 35 U.S.C. 154(b) by 56 days.

This patent is subject to a terminal disclaimer.

(21) Appl. No.: 13/106,540

(22) Filed: May 12, 2011

(65) Prior Publication Data

US 2011/0278871 A1 Nov. 17, 2011

Related U.S. Application Data

(60) Provisional application No. 61/395,561, filed on May 14, 2010.

(51) Int. Cl.
*B66C 1/12* (2006.01)

(52) U.S. Cl.
USPC ..... 294/74; 294/82.1

(58) Field of Classification Search
USPC ..... 294/74, 82.1, 82.11; 59/86
See application file for complete search history.

(56) References Cited

U.S. PATENT DOCUMENTS

| | | | | | |
|---|---|---|---|---|---|
| 1,244,658 | A | * | 10/1917 | Sunderland | 403/210 |
| 1,686,288 | A | * | 10/1928 | Meals | 294/74 |
| 2,124,912 | A | * | 7/1938 | Ehmann | 59/86 |
| 2,354,280 | A | * | 7/1944 | Russell | 294/74 |
| 2,435,336 | A | * | 2/1948 | Belvel | 59/86 |
| 2,629,625 | A | | 2/1953 | Phillips | |
| 3,083,991 | A | * | 4/1963 | Gale | 403/210 |
| 3,224,185 | A | * | 12/1965 | Grim et al. | 59/86 |
| 3,867,046 | A | * | 2/1975 | Fox | 403/210 |
| 4,079,584 | A | * | 3/1978 | Shahan | 59/35.1 |
| 4,139,179 | A | * | 2/1979 | Kukulski | 254/391 |
| 4,164,378 | A | * | 8/1979 | Linehan | 403/210 |
| 4,513,681 | A | * | 4/1985 | Crook, Jr. | 114/293 |
| 4,914,903 | A | * | 4/1990 | Bernt et al. | 59/86 |
| 4,993,769 | A | * | 2/1991 | Chapalain | 294/74 |
| 5,647,198 | A | * | 7/1997 | Mihailovic | 59/86 |
| 6,068,310 | A | * | 5/2000 | Fuller et al. | 294/215 |
| 7,654,594 | B2 | * | 2/2010 | Bisso, IV | 294/82.35 |
| 7,971,422 | B2 | * | 7/2011 | Shnayder et al. | 59/78 |
| 2009/0320248 | A1 | | 12/2009 | Naquin | |
| 2011/0052314 | A1 | * | 3/2011 | Lindsey | 403/210 |

FOREIGN PATENT DOCUMENTS

| | | |
|---|---|---|
| GB | 2255109 A | 10/1992 |

* cited by examiner

*Primary Examiner* — Saul Rodriguez
*Assistant Examiner* — Gabriela Puig
(74) *Attorney, Agent, or Firm* — Juan J. Lizarraga

(57) ABSTRACT

The detachable ears rope thimble comprised of thimble body, detachable ears and having the optional features of bale, main load pin sub assembly, and a restraning load sub assembly. The inventive thimble provides very high load capacity ability for wire or synthetic ropes. Furthermore the thimble assembly enables eye splicing on new ropes yet allows for the thimble addition to previously formed eyes without resplicing the eyes. The invention provides a thimble that fully contains even the oversize found in fresh synthetic ropes protecting them within an array of detachable ears from abrasion. The outer body has smooth form with embedded detachable ears and rounded edges preventing synthetic fiber damage.

14 Claims, 6 Drawing Sheets

DETACHABLE EARS ROPE THIMBLE

This application claims priority from U.S. Provisional Application Ser. No. 61/395,561 (the '561 application') filed May 14, 2010. The '561 application is incorporated here by reference.

BACKGROUND OF THE INVENTION

High capacity lifting systems involve rigging that frequently employ lines that are either high strength steel or the modern synthetic high strength lines. The synthetic lines with high strength fibers have advanced beyond available and suitable high strength thimbles. The thimbles are required to protect the synthetic and wire rope ends, termed eyes, from being crushed when the rope is attached to shackles or other connectors. The thimble's primary purpose is to control the rope eye radius under high loads. The strengths of some synthetic ropes have reached the capacity of steel ropes with the advantage of low weight. An example is a 3 inch diameter synthetic rope rated at nearly 900 metric tons breaking strength. While these modern ropes offer significant advantages due to their lighter weight and freedom from corrosions, they must be protected from abrasion. It is also important that the configuration of the eye be maintained geometrically to retain peak strength levels.

Apart from these issues it is very important to allow eyes previously braded into the ropes to be inserted into a thimble without the costly exercise of reforming the eyes by braiding. It is also beneficial if the eye can be retained within the thimble boundary without requiring manual lashing. Manual lashing requires materials that can be easily tom away or cut when dragged over a shop floor or job site with debris. Losing the braiding around the eye can allow damage to the eye and failure of the lifting rope creating safety issues and potential damage to equipment.

SUMMARY OF THE INVENTION

There are several unique and beneficial features of the detachable ears rope thimble that are currently not available in the market.

The thimble body of the invention is deeper than those available in the market place, furthermore the body is strengthened in the strategic areas that undergo high compression, shear loads and bending moments due to the rope tension being exerted on the thimble body. In areas away from highly loaded areas, the thimble body sections are reduced to allow increased ease and safety in handling.

The thimble body is also provided with rounded edges so that the thimble cannot damage the rope fibers during handling that could otherwise lead to reduced rope strength. The thimble body is preferentially made of high strength metals although it is evident that composite materials with internal metal stiffening in areas of high stress could be substituted.

The thimble body is provided with detachable ears. The detachable ears are recessed into the thimble body providing a smooth outline free of edges which could damage the rope fibers. The detachable ears are attached preferentially with fasteners that are also flush with the surface. The detachable ears cause the thimble to be ideal for fanning eyes in new wire or synthetic rope, furthermore the detachable ears allow rope with existing eyes to be readily fitted with a high strength thimble that will protect the eyes and retain the eye geometry to create the highest potential rope strength and highest safety rating. The material used for the ears can be selected from a broad range of metals, plastics or composites since the ears are not highly stressed during any stage of the operation. Their primary purpose is to retain rope within the confines of the thimble boundary to protect against abrasion. Their secondary purpose is to resist abrasion from rough handling on shop floors or job sites littered with debris and maintain their connection and position on the thimble body.

Apart from the basic features noted above, optional items can be added to the detachable ear thimble that yields certain other advantages not currently available in the market place. While most applications will employ the use of a standard shackle through the thimble body access hole, the thimble can be provided with a bale specifically mated to the configuration of the thimble for special applications such as short coupling two thimbles together while keeping them in line. This feature would allow the thimbles to be wound onto a drum along with the wire rope for special applications where extreme lengths were required. The thimble could further be equipped with a diaphragm in the lower portion of the eye to provide means of a retainer or stop off bar to support the suspended lines while an upper thimble is disconnected.

DETAIL DESCRIPTION OF THE INVENTION

Figure 1:
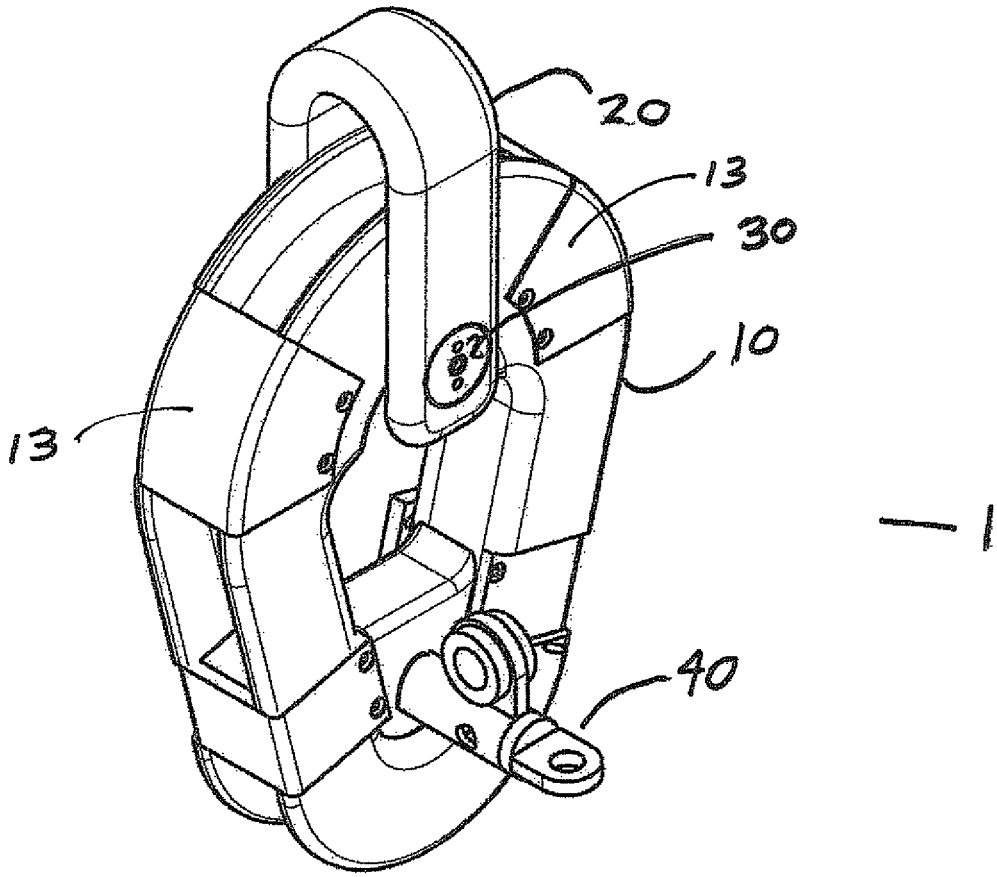
FIG. 1 depicts the inventive detachable ears rope thimble in an isometric view without the rope being shown and without any attachments to the bale. The major components that extend outside the thimble body can be seen in this view.

FIG. 1 presents the invention, termed a detachable ears rope thimble 1, consisting of an assembly that includes a thimble body 10 with rope retainers 13, a bale 20, a main load pin sub assembly 30 and a restraining load sub assembly 40.

Figure 2:
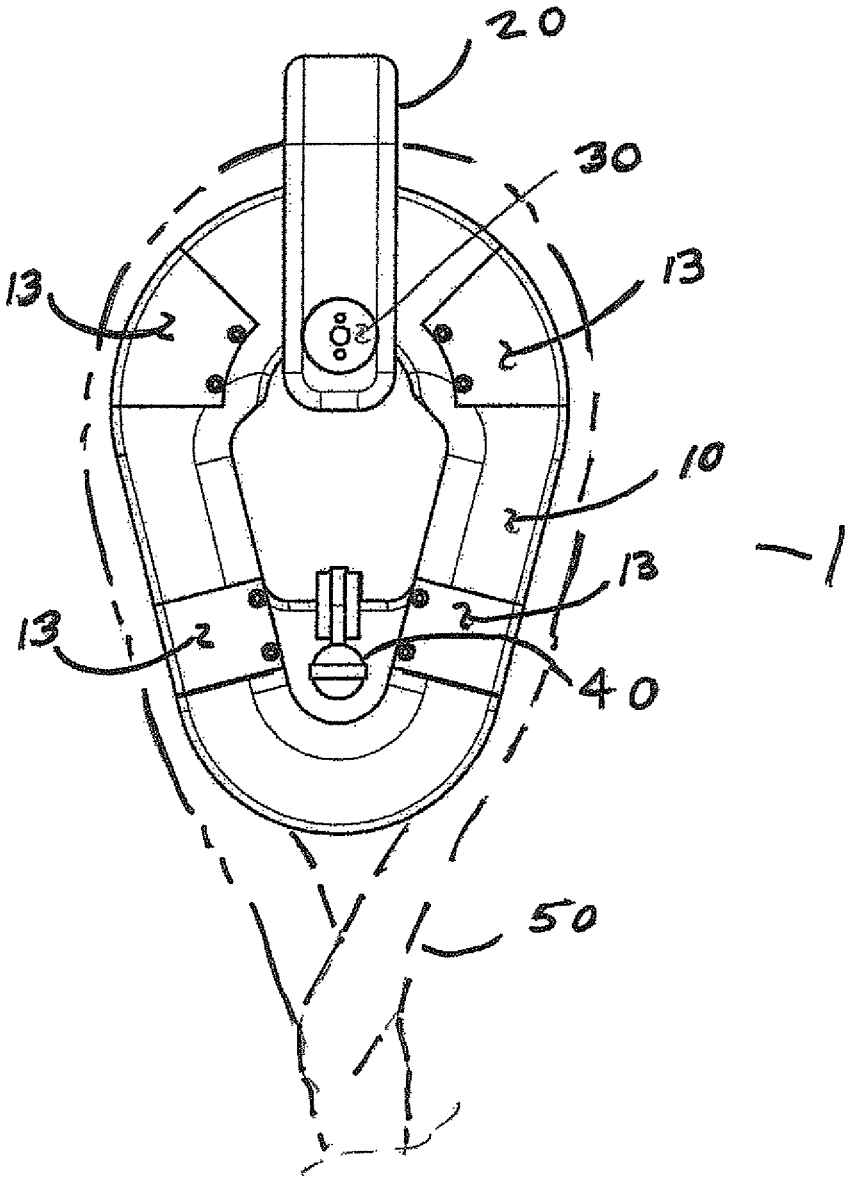
FIG. 2 depicts the inventive detachable ears rope thimble in a side view.
Figure 3:
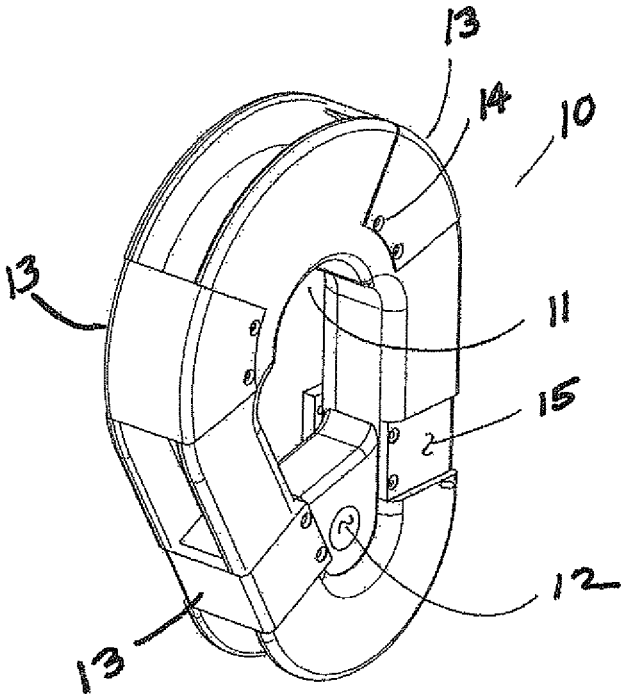
FIG. 3 depicts the thimble body in an isometric view.

The thimble body 10 shown in FIGS. 1 and 2 and separate from the assembly in FIG. 3, is formed similar to that of a conventional rope thimble from the standpoint that a synthetic rope 50 or rope of other construction, indicated in phantom lines in FIG. 2, can be wrapped around the thimble body 10 and secured and thereby transfers a tension load from the rope 50 to the structure of the thimble body 10.

As illustrated by the components shown in FIGS. 1 and 2, the detachable ears rope thimble 1 transfers loads from the rope 50 through the thimble body 10 via the main load pin sub assembly 30 to the bale 20 and consequently to other connectors or chain elements. The bale 20 is removable when the thimble body 10 is restrained and the tension can therefore be relieved.

Figure 5:
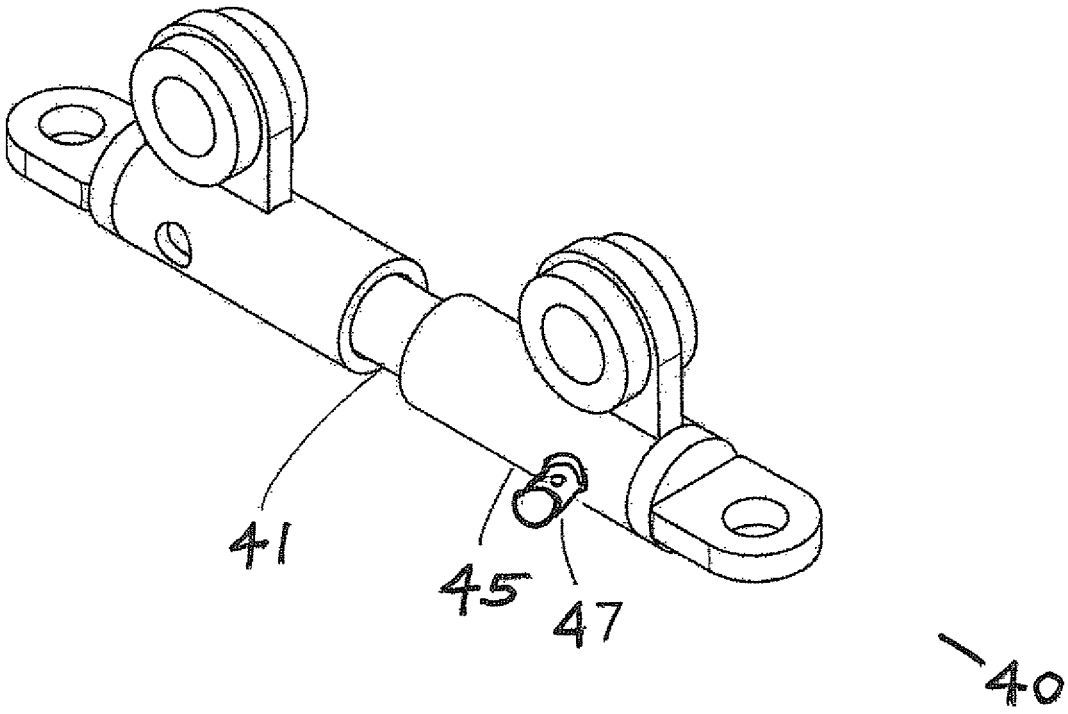
FIG. 5 depicts the restraining load sub assembly in an isometric view.

In FIG. 3, the thimble body 10 is shown to include a cavity 11 through which the main load pin sub assembly 30 extends. The thimble body 10 also includes a second means of connection illustrated by a hole 12 by which the restraining load sub assembly 40 connects. The second means to restrain the thimble is shown in FIG. 5, utilizing a restraining pin 41 with padeye caps 45 secured by pins 47. It is apparent that various means of attachment variations can be made in the side or other areas of thimble body 10 that can be used to restrain the thimble body 10 from moving to allow the bale 20 to be removed even while the rope 50 is under tension.

Also shown in FIG. 3 are the rope retainers 13 which are fitted into a recess 15 of the thimble 10 to provide an overall smooth contour to prevent sharp corners and other appurtenances from catching on the decks of workboats. The contours, in fact, are provided with a radius that is greater than 10 percent of the overall rope diameter. An example would be to preferentially use a 2 inch radius for a 7 inch diameter synthetic rope to prevent the thimble body, bale or connector edges from damaging the synthetic rope. The rope retainers 13 are shown provided with holes 14 by which the rope retainer 13 can be held firmly to the thimble body 10. It is evident that variations of the connections of the rope retainer 13 to the thimble body 10 may be made more complex. However, the simplest form is shown as the preferred embodiment.

Figure 4:
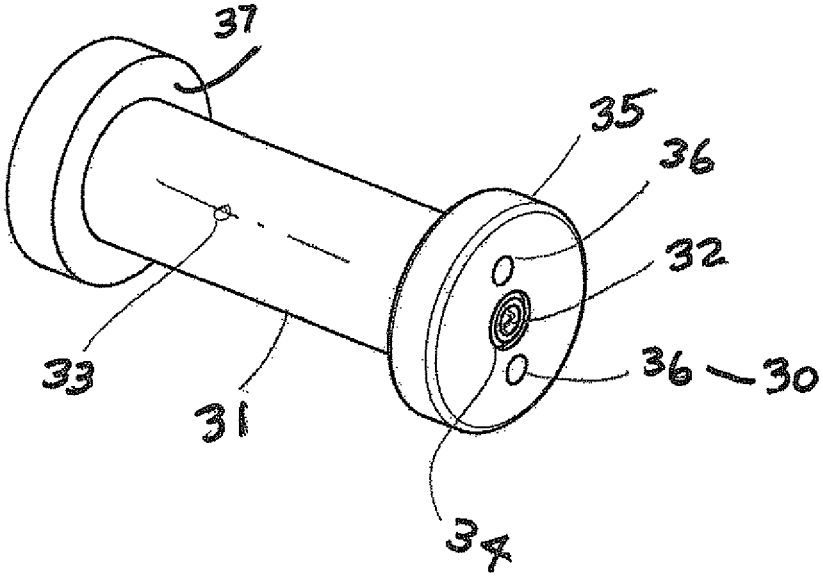
FIG. 4 depicts the main load pin sub assembly in an isometric view.
Figure 6:
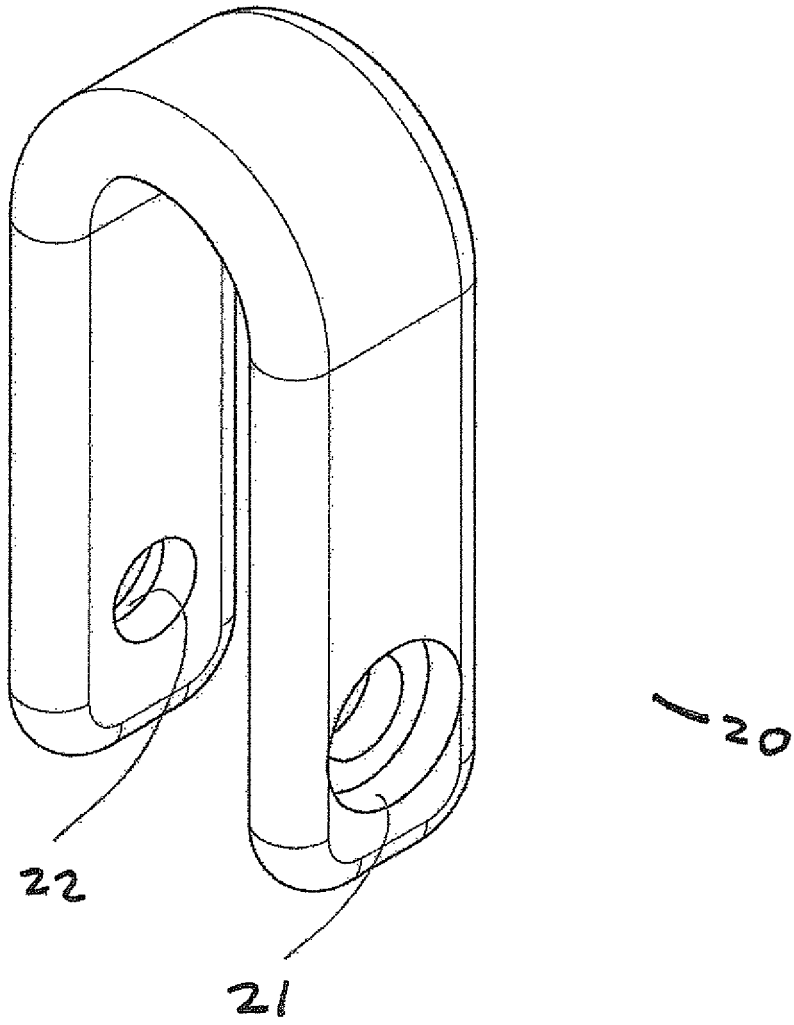
FIG. 6 depicts the bale in an isometric view.

FIG. 4 depicts the main load pin sub assembly 30 with a main load pin 31 and a circular nut plate 35. The main load pin assembly 30 is configured to present a surface free of sharp edges to prevent damage to synthetic rope and to prevent snags. The main load pin 31 is provided with threaded holes 32 at both ends on its centerline 33 to provide for use of screw eyes and other fittings that connect into the threaded holes 32 to lift and assist the positioning and removal of the main load pin 31 from the thimble body 10 and bale 20 when connected. The main load pin 31 is configured with a shoulder 37 that seats within a recess 21 of the bale 20 as shown in FIG. 6. A threaded end 34 is provided opposite the shoulder 37 on the main load pin 31 to which a circular nut plate 35 is attached.

The circular nut plate 35 of the main load pin sub assembly 30, shown in FIG. 4, also seats within a recess 22 of the bale 20. The circular nut plate 35 includes spanner holes 36 that extend through its thickness. The radii of the spanner holes 36 are less than the radius of the body of the main load pin 31. This feature allows the spanner holes to be used to lock the circular nut plate 35 to the main load pin 31 by drilling and tapping at final assembly. By restraining the circular nut plate 35 directly to the main load pin 31, the circular nut plate 35 is prevented from loosening although the main load pin 31 may be allowed to rotate.

FIG. 5 depicts the restraining load sub assembly 40 with a main pin 41, padeye caps 45 and retainer pins 47. The provision for end mounted connections such as the padeye caps 45 or similar appurtenances to which external cable or other systems can be attached provides restraint for the rope 50 by means of the thimble body 10 allowing tension to be transferred from the bale 20 allowing separations and connections to be under slack conditions.

FIG. 6 depicts the bale 20 that is configured to pass through chain when disconnected from the thimble body 10. The bale 20 is also configured to connect two bales together where intended or to utilize a master link or similar connecting link for attachments. The cross section of the bale is configured to reduce stress intensification factors and to reduce contact stresses when interconnecting two bales or a bale 20 to chain or chain fittings.

The present invention provides features which allow one end of the connector, the bale 20 or other components to which the tension has been relieved, to be removed while restraining the thimble body 10 to which the rope 50 is attached. The thimble body 10, in turn, restrains the synthetic or other rope 50 while under tension. This feature is both unique and useful for offshore mooring systems composed of multiple synthetic and other rope sections in deep water.

Those of skill in the art will recognize that numerous changes and modifications may be made to the exemplary systems and methods described herein without departing from the scope and spirit of the invention. In fact, the invention is intended to be limited only to the claims which follow and at permissible equivalents thereof.

What is claimed is:

1. A detachable ear rope thimble suitable for wire or synthetic rope comprising a thimble body with rounded edges and outer sides configured to receive wire or synthetic rope wrapped around the thimble body, rope retainers to retain the wire or synthetic rope within the thimble body, and wherein the thimble body is configured to optimize the strength to weight ratio with the addition of rounded edges to prevent damage when utilized with synthetic rope, and;

the thimble body is also configured to provide the full embedment of the synthetic rope within its outer boundaries thereby preventing damage to fibers of the synthetic rope and;

the thimble body is further configured to receive the rope retainers in recesses around the outer sides of the thimble body to entrap the rope and retain it within the confines of the thimble body.

2. The detachable ear rope thimble of claim 1 wherein the configuration of the thimble body is comprised of an outer boundary configured to surround the rope in a teardrop shape with a large internal cavity for weight savings.

3. The detachable ear rope thimble of claim 1 further comprising a bale with right and left sides configured to fit into recesses on the outer sides of the thimble thereby minimizing the overall width of the assembly thereby minimizing internal bale width further reducing combined stress loading allowing a reduced cross section thereby allowing connection of smaller diameter high strength chain links and high strength mooring connector links, and wherein the bale is further configured within the thimble recesses to selectively allow or prevent rotation of the thimble and bale for various applications, and the cross section of the bale is further configured to approximate the radius of other connectors or chain elements thereby reducing localized compressive stress regions and the corresponding fretting and wear caused to motions during extended installation durations.

4. The detachable ear rope thimble of claim 3 further comprising a main load pin with two ends configured to recess into both the sides of the bale preventing exposed edges from damaging the synthetic rope fibers and where the main load pin is further configured to accept recessed locking devices to retain the main load pin within the bale thereby fixing the bale to the thimble.

5. The detachable ear rope thimble of claim 4 further comprising a restraining pin utilized within a thimble cavity to provide means to transfer synthetic rope tension from the thimble and bale to the restraining pin thereby allowing the bale to be removed.

6. The detachable ear rope thimble of claim 5 wherein the restraining pin has padeye caps, which provide means for hold-back wires or chains to anchoring points suitable to accept the transferred synthetic rope tension.

7. The detachable ear rope thimble of claim 4 wherein the main load pin is threaded on either or both ends with circular nut plates, residing within added recesses of the bale.

8. The detachable ear rope thimble of claim 7 wherein circular nut plates have radial holes or slots are provided and these holes or gaps provide means for the circular nut plates to be fixed by fasteners to the main load pin thereby preventing rotation of the main load pin within the thimble body from loosening the threaded connection of the circular locking plate and main load pin.

9. The detachable ear rope thimble of claim 8 wherein the radial holes or slots in the circular locking plate double as spanner wrench access means.

10. A detachable ear rope thimble suitable for wire or synthetic rope comprising a thimble body with rounded edges and outer sides configured to receive wire or synthetic rope wrapped around the thimble body, rope retainers to retain the wire or synthetic rope within the thimble body, and wherein the thimble body is configured to optimize the strength to weight ratio with the addition of rounded edges to prevent damage when utilized with synthetic rope, and;

the thimble body is also configured to provide the full embedment of the synthetic rope within its outer boundaries thereby preventing damage to fibers of the synthetic rope and;

the thimble body is further configured to receive the rope retainers in recesses around the outer sides of the thimble body to entrap the rope and retain it within the confines of the thimble body, and;

wherein the configuration of the thimble body is comprised of an outer boundary configured to surround the rope in a teardrop shape with a large internal cavity for weight savings, and;

wherein the detachable ear rope thimble further comprises a bale with right and left sides configured to fit into recesses on the outer sides of the thimble thereby minimizing the overall width of the assembly thereby minimizing internal bale width further reducing combined stress loading allowing a reduced cross section thereby allowing connection of smaller diameter high strength chain links and high strength mooring connector links, and wherein the bale is further configured within the thimble recesses to selectively allow or prevent rotation of the thimble and bale for various applications, and the cross section of the bale is further configured to approximate the radius of other connectors or chain elements thereby reducing localized compressive stress regions and the corresponding fretting and wear caused to motions during extended installation durations, and;

wherein the detachable ear rope thimble further comprises a main load pin with two ends configured to recess into both the sides of the bale preventing exposed edges from damaging the synthetic rope fibers and where the main load pin is further configured to accept recessed locking devices to retain the main load pin within the bale thereby fixing the bale to the thimble, and;

wherein the detachable ear rope thimble further comprises a restraining pin utilized within a thimble cavity to provide means to transfer synthetic rope tension from the thimble and bale to the restraining pin thereby allowing the bale to be removed.

11. The detachable ear rope thimble of claim 10 wherein the restraining pin has padeye caps, which provide means for hold-back wires or chains to anchoring points suitable to accept the transferred synthetic rope tension.

12. The detachable ear rope thimble of claim 11 wherein the main load pin is threaded on either or both ends with circular nut plates, residing within added recesses of the bale.

13. The detachable ear rope thimble of claim 12 wherein circular nut plates have radial holes or slots are provided and these holes or gaps provide means for the circular nut plates to be fixed by fasteners to the main load pin thereby preventing rotation of the main load pin within the thimble body from loosening the threaded connection of the circular locking plate and main load pin.

14. The detachable ear rope thimble of claim 13 wherein the radial holes or slots in the circular locking plate double as spanner wrench access means.

* * * * *